US005239990A

United States Patent [19]

Delphia

[11] Patent Number: 5,239,990

[45] Date of Patent: Aug. 31, 1993

[54] SNORKEL WITH FLOATING INTAKE VALVE

[76] Inventor: John B. Delphia, 1021 Schuyler Dr., White Lake, Mich. 48383

[21] Appl. No.: 909,954

[22] Filed: Jul. 7, 1992

Related U.S. Application Data

[63] Continuation-in-part of Ser. No. 701,748, May 17, 1991, abandoned.

[51] Int. Cl.[5] ..... B63C 11/16

[52] U.S. Cl. ..... 128/201.11; 128/205.24; 128/201.28

[58] Field of Search ..... 128/201.11, 207.14, 128/206.29, 207.16, 205.24, 201.27, 201.28

[56] References Cited

U.S. PATENT DOCUMENTS

| | | | |
|---|---|---|---|
| 3,435,839 | 4/1969 | Elder | 128/205.24 |
| 3,721,236 | 3/1973 | Bardehle | 128/201.11 |
| 3,768,504 | 10/1973 | Rentsch, Jr. | 128/201.11 |
| 3,860,042 | 1/1975 | Green | 128/201.11 |
| 4,610,246 | 9/1986 | Delphia | 128/201.11 |
| 4,793,341 | 12/1988 | Arasmith | 128/201.11 |
| 4,872,453 | 10/1989 | Christianson | 128/201.11 |
| 5,143,059 | 9/1992 | Delphia | 128/201.11 |

*Primary Examiner*—Edgar S. Burr
*Assistant Examiner*—Aaron J. Lewis
*Attorney, Agent, or Firm*—Reising, Ethington, Barnard, Perry & Milton

[57] ABSTRACT

A fresh air snorkel assembly (10) comprises a breathing tube (12) having a mouthpiece (18) at one end of the tube and an air intake opening (16) at the other end of the tube. The breathing tube (12) further includes an exhaust valve (22) disposed between the mouthpiece (18) and the air intake opening (16), and an intake valve (20,24) disposed adjacent to the air intake opening. The intake valve (20,24) includes floating intake valve means (24) for moving totally toward and away from the valve seat (20) for opening and closing the air intake opening (16) in response to the breathing of the diver. The air intake end of the snorkel is curved so that the air intake opening (16) faces the waterline.

13 Claims, 2 Drawing Sheets

SNORKEL WITH FLOATING INTAKE VALVE

This application is a continuation-in-part of U.S. patent application No. 701,748, filed May 17, 1991, now abandoned.

TECHNICAL FIELD

The subject invention relates to fresh air snorkels of the type used in the sport of skin diving. More specifically, the subject invention relates to an intake valve assembly incorporated in such snorkels.

BACKGROUND OF THE INVENTION

Modern diving snorkels include fluid flow systems which are intended to facilitate underwater breathing in two ways: by expelling water and exhaust gases from the snorkel; and by providing an unimpeded supply of fresh air to the diver. These objectives may be accomplished by utilizing a system of check valves on the snorkel in the manner shown in U.S. Pat. No. 4,655,212 to Delphia and U.S. Pat. No. 3,860,042 to Green. Such systems include an intake valve disposed near the top of the snorkel for allowing fresh air into the snorkel tube. Such systems also include an exhaust valve disposed along the snorkel tube between the snorkel mouthpiece and the air intake valve. The respective valves function so that when the diver inhales, the intake valve opens and the exhaust valve closes. In this manner only fresh air may enter the snorkel tube. When the diver exhales, the intake valve closes and the exhaust valve opens. The pressure from the diver's exhaling forces exhaust gases and any water which may have entered the snorkel tube out of the snorkel tube through the exhaust valve.

The intake valve in the prior art patents is generally a flexible diaphragm which has a center fixed to a valve seat located near the air intake opening of the snorkel tube. The outer portion of the diaphragm flexes into and out of engagement with the valve seat to close or open the air passageway in response to the diver's breathing. The center of the diaphragm remains in the same location throughout the cycle—fixed closely to the valve seat.

Unfortunately, since the entire diaphragm remains so close to the air intake opening when the diver inhales, the flow of air into the tube through the air intake opening is impeded, with the result that breathing is more difficult for the diver than if the diaphragm could move totally away from the air intake opening.

Also, because the air intakes face up (i.e away from the waterline) on the Delphia and Green snorkels when these snorkels are used in the above-water position, water splashing into the air intake can enter by force of gravity into the breathing tube, hampering the breathing of the diver.

SUMMARY OF THE INVENTION AND ADVANTAGES

A diving snorkel assembly assists the breathing of a skin diver when the face of the skin diver is in a body of water below the waterline by providing an air passageway between the mouth of the skin diver and the air above the waterline. The assembly comprises a breathing tube having an inner surface defining an air passageway extending between first and second ends of the tube. The first end defines an air intake opening in fluid communication with the air passageway. The assembly also includes a mouthpiece disposed on the second end of the tube in fluid communication with the air passageway and adapted to be received into the mouth of a skin diver. The assembly also includes a valve seat disposed adjacent the air intake opening. The assembly is characterized by floating intake valve means disposed in the air passageway for total movement linearly into engagement with the valve seat when pressure in the tube exceeds ambient pressure and for total movement away from the valve seat when ambient pressure exceeds pressure in the tube. The breathing tube includes a straight intermediate portion and a curved top portion together defining an inverted "J" shape whereby gravity will force the floating intake valve means to engage the valve seat when the snorkel is in its operative position with the air intake opening being above the waterline and the mouthpiece being below the waterline.

Because the entire intake valve means not—just the outer portion—moves away from the valve seat when the diver inhales, the air passageway into the tube is larger, and thus breathing for the diver is easier.

Also, because the air intake faces the waterline, gravity will close the air intake valve, preventing water from splashing into the breathing tube. This also makes breathing easier for the diver.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
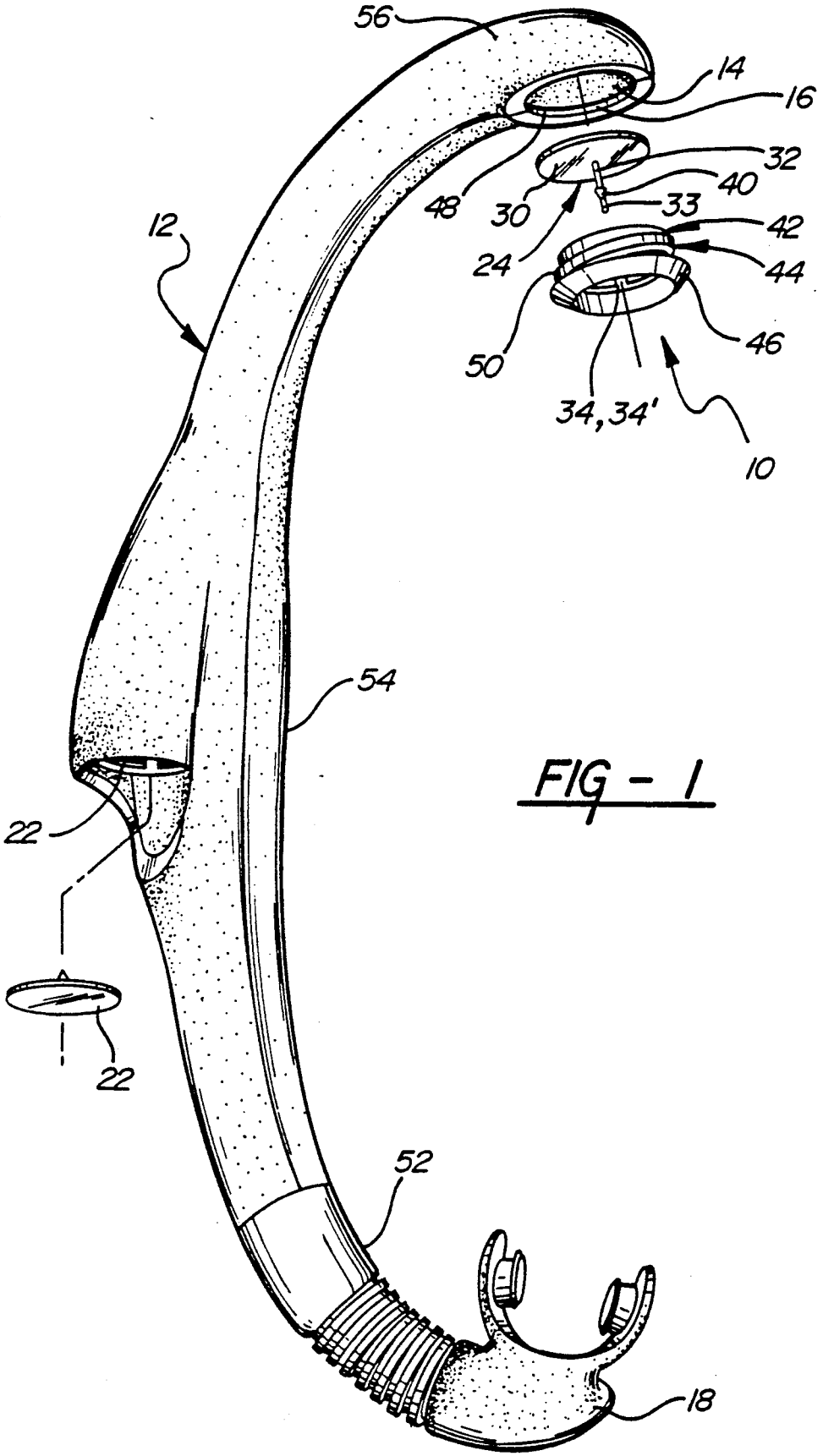
FIG. 1 is a perspective view of the fresh air snorkel.
Figure 2:
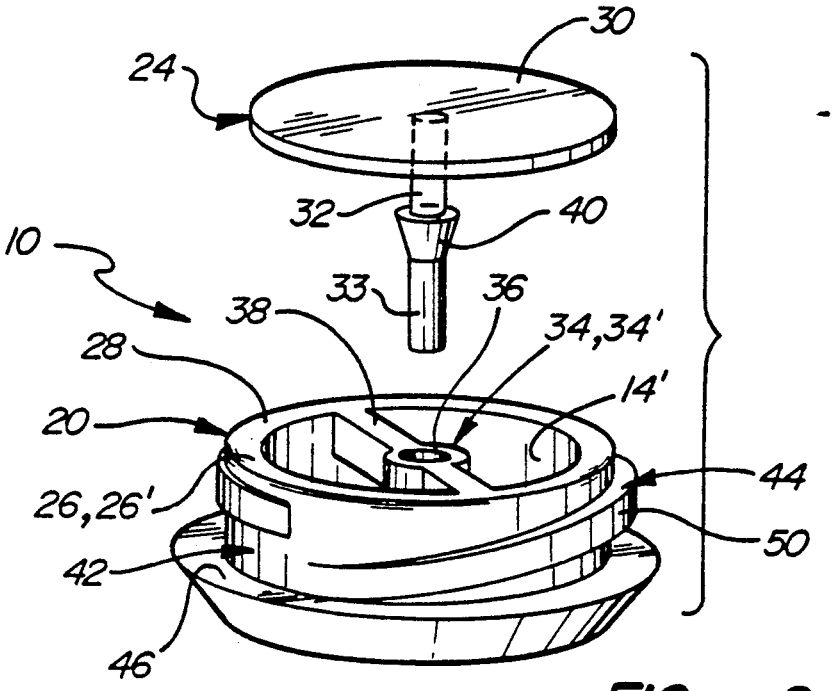
FIG. 2 is a perspective view of the floating intake valve means and the seat tube.

The diving snorkel assembly generally shown at 10 comprises a breathing tube generally indicated at 12 having an inner surface 14 defining an air passageway extending between first and second ends of the tube where the first end defines an air intake opening 16 in fluid communication with the passageway. The assembly further comprises a mouthpiece 18 disposed on the second end of the tube 12 in fluid communication with the air passageway and adapted to be received into the mouth of a skin diver. The assembly 10 also comprises a valve seat generally indicated at 20 disposed adjacent to the air intake opening 16. In addition, the snorkel includes an exhaust valve assembly 22 disposed along the breathing tube 12 between the mouthpiece 18 and the air intake opening 16. The assembly is characterized by floating intake valve means generally indicated at 24 disposed in the air passageway for total movement linearly into engagement with the valve seat 20 when pressure in the tube 12 exceeds ambient pressure and for total movement away from the valve seat 20 when ambient pressure exceeds pressure in the tube. Pressure in the breathing tube 12 is usually greater than ambient pressure (i.e., the pressure of the environment surrounding the breathing tube) when the diver exhales into the breathing tube. Pressure in the breathing tube 12 is generally less than ambient pressure when the diver inhales. The breathing tube includes a straight intermediate portion 54 and a curved top portion 56 together defining an inverted "J" shape whereby gravity will force the floating intake valve means 24 to engage the valve seat 20 when the snorkel is in its operative position with the air intake opening 16 being above the waterline and with the mouthpiece 18 being below the waterline.

The valve seat 20 includes an abutment or flange 26 extending from the inner surface 14 of the breathing tube 12. The flange may extend radially inwardly or in some other fashion from the inner surface 14. The abutment or flange 26 has a rounded or dome-like surface 28 for engaging the floating intake valve means 24. This surface 28 is rounded to minimize the strength of a moisture seal which may form between the floating intake valve means 24 and the abutment or flange 26 which comprises the valve seat 20. In other words the floating intake valve means 24 can easily disengage from the rounded abutment surface 28 when the diver inhales. Enough surface area of contact remains between the floating intake valve means 24 and the abutment or flange 26 to effect a positive seal of the air intake 16 when the diver exhales.

The floating intake valve means 24 comprises a flexible disc 30. The disc 30 is made from a rubber type material, i.e. one having flexibility and "memory" to flex back to a predetermined shape in the absence of contorting forces. The disc 30 should be flexible enough to bend partly around the rounded surface 28 of the flange 26,26' when the diver exhales. This material is preferably silicon. The floating intake valve means 24 could be any other object which can be guided into and out of engagement with the valve seat 20 for sealing the air passageway closed in response to the exhaling of the diver, e.g. a floating ball.

The floating intake valve means 24 further includes guide means 32 for guiding the movement of the intake valve means 24 in relationship to the valve seat 20. The guide means 32 comprises an elongated stem 32 having a first end attached to the center of the disc and a second end disposed opposite the disc for engaging with the valve seat 20. Alternatively, the guide means 32 could be a plurality of fingers attached to the disc 30 and extending away from the disc for some type of engagement with the valve seat 20. The guide means could just as easily be a track in the wall of the breathing tube or a restrictive cage.

The valve seat 20 includes a stem guide generally indicated at 34 disposed in the air passageway and attached to the inner surface 14 of the breathing tube 12 between the valve seat 20 and the air intake opening 16. The stem guide 34 includes a tubular socket 36 disposed along the stem guide for telescopingly receiving the stem 32. Similarly, it may be said that the stem 32 and the socket 36 engage in a mating fashion where the stem is the male part and the socket is the female part. The stem guide 34 includes a bridge 38 which extends completely across the air passageway and attaches to the inner surface 14 of the breathing tube 12. Alternatively, the stem guide 34 may be an arm extending from the inner surface 14 of the breathing tube 12.

The stem 32 has a stem length and the socket 36 has a socket length which is less than the stem length. The stem 32 includes an enlargement 40 disposed between first and second ends of the stem so that the stem is retained in sliding, telescoping engagement with the socket. In other words, the stem 32 is free to slide axially through the socket 36 of the stem guide 34 between the end of the stem which attaches to the disc 30 and the part of the stem which has the enlargement 40 thereon. The distance between the first end of the stem 32 and the enlargement 40 must be greater than the distance along the length of the socket 36. The stem 32 includes a threading tip 33 extending below the enlargement 40 for threading through the socket 36. When the stem 32 is initially engaged in the socket 36, the tip 33 may be gripped as it threads through the socket in order to pull the stem 32, with the enlargement 40 thereon, through the socket. Once the enlargement 40 passes fully through the socket 36, it cannot be pulled back through.

Figure 3:
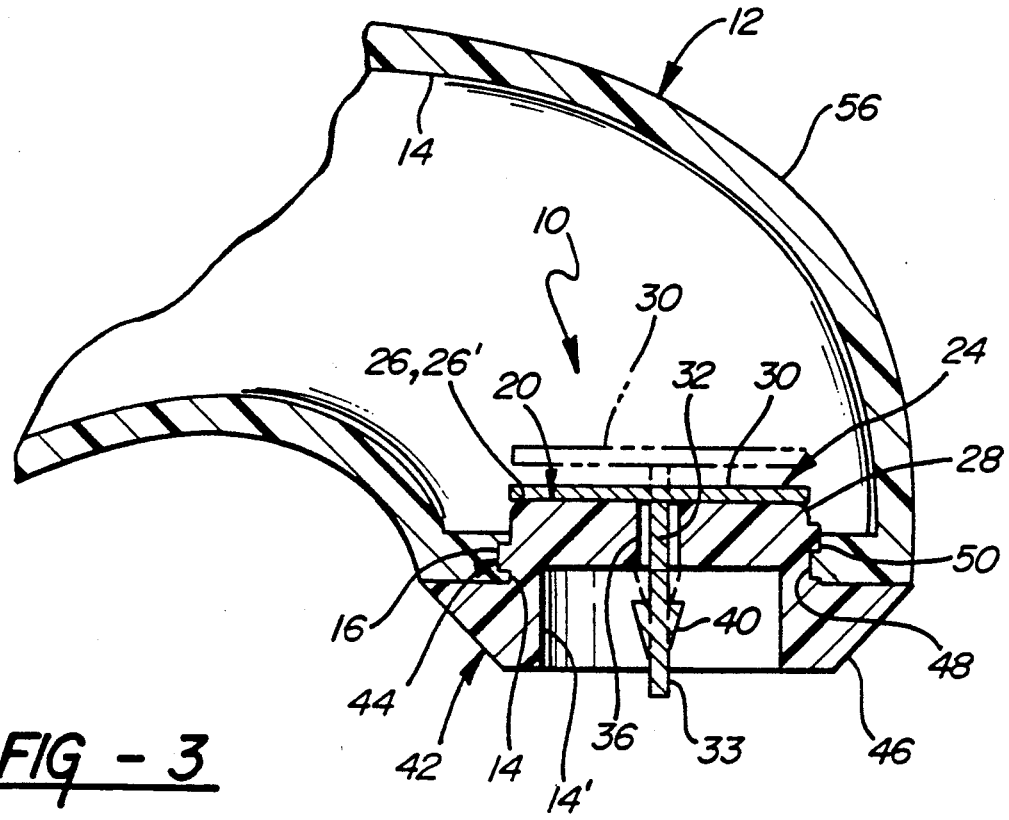
FIG. 3 is a section of the valve seat and floating intake valve means as disposed in the breathing tube.

The valve seat 20 may be formed as an integral part of the breathing tube 12 as suggested above. Preferably, though, the valve seat 20 comprises a removable seat tube generally indicated at 42 including an outer surface having seat retaining means generally indicated at 44 for retaining the seat tube 42 to the inner surface 14 of the breathing tube 12 adjacent the air intake opening 16. The seat tube 42 further includes an inner surface 14' defining an air passageway generally coincident with the air passageway of the breathing tube 12. The seat tube 42 fits within the breathing tube 12 so that the walls of the seat tube are coaxial with the wall of the breathing tube adjacent the air intake opening 16 which surrounds the seat tube. The seat tube 42 also includes a first end disposed in the air intake opening 16 of the breathing tube 12 where the first end of the seat tube forms a flange or abutment 26' when disposed within the breathing tube. The abutment or flange 26' extends radially outwardly from the inner surface 14' of the seat tube 42. The flange 26' also includes the rounded surface analogous to rounded surface 28. As shown in FIG. 3, the second end of the seat tube is the portion which engages the inner wall 14 of the breathing tube 12 adjacent the air intake opening 16. The first end of the seat tube 15 contacts nothing; it is surrounded by space. In this arrangement, air can flow in through the seat tube 42 and around the disc 30 when the disc 30 moves away from the valve seat 20. In addition, the seat tube 42 includes the stem guide 34' extending across the air passageway and attached to the inner surface 14' of the seat tube. Finally, the seat tube 42 includes an outer flange 46 for engaging the breathing tube 12 immediately at the air intake opening 16 for limiting the extent to which the seat tube may be threaded into the breathing tube.

The breathing tube 12 includes threads 48 disposed on its inner surface 14 adjacent the air intake opening 16. The seat retaining means 44 on the seat tube 42 comprises threads 50 disposed on the outer surface of the seat tube for threadedly engaging the threads 48 on the inner surface 14 of the breathing tube 12.

The breathing tube 12 includes a curved cheek portion 52 for curving around the cheek of the diver. The curved check portion 52 may include a rigid curved portion or a section of flexible accordion-like tubing which can be manipulated to assume a variety of curved or straight shapes. The cheek portion 52 is fluidly connected to a generally straight intermediate portion 54, which in turn fluidly connects to a curved top portion 56. The mouthpiece 18 attaches to the free end of the cheek portion 52. The exhaust valve 22 is disposed along the intermediate portion 54. The valve seat 20 is disposed in the curved top portion 56. The intermediate portion 54 and the curved top portion 56 together define a "J" shape. Said another way, the curved top portion 56 defines a "U" shape. Said yet another way, the air intake 16 faces the mouthpiece 18 so that the snorkel has a "C" shape. Either way one views this situation, the idea is that the breathing tube 12 goes through a 180 degree change of direction toward the air intake opening 16. This is so that the air intake opening 16 faces the waterline in the operative position—i.e. when the air intake opening 16 is above water and the mouthpiece 18 is below water. When the air intake opening 16 faces the water gravity will force the floating intake valve means 24 (i.e. the flexible disk) toward the valve seat 20 to close the air intake opening (when the diver is not breathing) and prevent water from splashing into the breathing passageway.

Prior to use of the snorkel 10, the floating intake valve 24 should be attached to the valve seat tube 42 inserting the second end of the stem 32 into the stem guide 34 until the enlargement 40 is all the way through the socket 36. This enlargement 40 should prevent the second end of the stem 32 from being pulled back through the socket 36. Once the floating intake valve 24 is attached to the valve seat tube 42, the valve seat tube should be threaded into the breathing tube 12.

In operation, the floating intake valve means 24 floats into and out of engagement with the valve flange 26 of the seat 20 in response to breathing of the diver. When the diver is neither inhaling nor exhaling, gravity will draw the disc 30 into engagement with the valve seat 20 to close the air intake opening 16 and prevent water from splashing into the breathing passageway. When the diver inhales through the mouthpiece 18, the exhaust valve 22 closes, preventing air or water entering the breathing tube 12 therethrough. Also, the disc 30 is drawn by the diver's breath completely away from the rounded surface 28 of the flange 26 of the valve seat 20. This movement of the disc 30 opens the air intake 16, allowing air to flow into the breathing tube 12. The movement of the disc 30 is limited by the length of the stem 32: the stem 32 cannot be pulled through the socket 36 because of the enlargement 40 disposed on the stem's end. When the diver exhales, the force of the diver's breath pushes the disc 30 against the rounded surface 28 of the flange 26, 26', closing the air intake 16. The disc 30 is flexible to the extent that the edges of the disc can flex over the rounded surface 28 of the flange 26,26', to effect a more positive seal of the air intake 16. The fluid in the breathing tube 12 is thus forced out of the tube through the exhaust valve 22, which opens when the diver's breath makes the pressure in the breathing tube 12 greater than the pressure in the environment around the tube.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed:

1. A diving snorkel assembly (10) for use in assisting the breathing of a skin diver when the face of the skin diver is in a body of water below the waterline by providing an air passageway between the mouth of the skin diver and the air above the waterline, said assembly comprising:

a breathing tube (12) having an inner surface (14) defining an air passageway extending between first and second ends of said tube (12), said first end defining an air intake opening (16) in fluid communication with said air passageway;

a mouthpiece (18) disposed on said second end of said tube (12) in fluid communication with said air passageway and adapted to be received into the mouth of a skin diver;

a valve seat (20) disposed adjacent said air intake opening (16);

characterized by floating intake valve means (24) disposed in said air passageway for total movement linearly into engagement with said valve seat (20) when pressure in said tube (12) exceeds ambient pressure and for total movement away from said valve seat when ambient pressure exceeds pressure in said tube (12);

said breathing tube including a straight intermediate portion (54) and a curved top portion (56) together defining an inverted "J" shape whereby gravity will force said floating intake valve means (24) to engage said valve seat (20) when said snorkel is in its operative position with said air intake opening (16) being above the waterline and with said mouthpiece being below the waterline (18).

2. An assembly (10) as set forth in claim 1 further characterized by said floating intake valve means (24) including guide means (32) for guiding the movement of said intake valve means (24) in relationship to said valve seat (20).

3. An assembly (10) as set forth in claim 2 further characterized by said guide means (32) comprising an elongated stem (32) having a first end attached to said sliding intake valve means (24) and a second end disposed opposite said intake valve means.

4. An assembly (10) as set forth in claim 3 further characterized by said valve seat (20) including a stem guide (34,34') disposed in said air passageway and attached to said inner surface (14,14') of said breathing tube (12) between said valve seat (20) and said air intake opening (16).

5. An assembly (10) as set forth in claim 4 further characterized by said stem guide (34,34') including a tubular socket (36) disposed in said stem guide (34,34') between said first and second ends of said stem (32) for telescopingly receiving said stem (32).

6. An assembly (10) as set forth in claim 5 further characterized by said stem (32) having a stem length and said socket (36) having a socket length less than said stem length.

7. An assembly (10) as set forth in claim 6 further characterized by including an enlargement (40) disposed on said stem (32) between said first and second ends of said stem so that said stem (32) is retained in sliding telescoping engagement with said socket (36).

8. An assembly (10) as set forth in claim 1 further characterized by said floating intake valve means (24) comprising a flexible disc (30).

9. An assembly (10) as set forth in claim 1 further characterized by said valve seat (20) including a flange (26) extending radially from said inner surface (14,14') of said breathing tube (12) and having a rounded surface (28) for engaging said floating intake valve means (24) and for preventing a moisture seal from developing between said valve seat and said floating intake valve means.

10. An assembly (10) as set forth in claim 1 further characterized by said valve seat (20) comprising a removable seat tube (42) including: an outer surface having seat retaining means (44) for retaining said seat tube (42) to said inner surface (14) of said breathing tube (12); an inner surface (14') defining an air passageway coincident with said air passageway of said breathing tube (12); a first end disposed in said air intake opening (16) of said breathing tube (12); said first end of said seat tube (42) forming a flange (26'), said seat tube (42) further including a stem guide (34') extending across said air passageway and attached to said inner surface (14') of said seat tube (42).

11. An assembly (10) as set forth in claim 10 further characterized by said breathing tube (12) including threads (48) disposed on said inner surface (14) of said breathing tube (12) adjacent said air intake opening (16).

12. An assembly (10) as set forth in claim further characterized by said seat retaining means (44) comprising threads (50) disposed on said outer surface of said seat tube for threadedly engaging said threads (48) on said inner surface (14) of said breathing tube (12).

13. An assembly (10) as set forth in claim 8 further characterized by said disc (30) being made from silicon.

* * * * *